United States Patent [19]

Wagener et al.

[11] 4,280,033

[45] Jul. 21, 1981

[54] PROCESS AND APPARATUS FOR THE THERMAL TREATMENT OF COAL

[75] Inventors: Dietrich Wagener; Horst Fach; Hayri Ergun, all of Essen, Fed. Rep. of Germany

[73] Assignee: Didier Engineering GmbH, Essen, Fed. Rep. of Germany

[21] Appl. No.: 23,093

[22] Filed: Mar. 22, 1979

[30] Foreign Application Priority Data

Mar. 22, 1978 [DE] Fed. Rep. of Germany ..... 2812521

[51] Int. Cl.[3] ..... H05B 6/78

[52] U.S. Cl. ..... 219/10.55 A; 34/1; 219/10.55 F

[58] Field of Search ..... 219/10.55 A, 10.55 R, 219/10.55 F, 10.55 M, 10.55 E, 10.71, 10.69; 34/1, 4

[56] References Cited

U.S. PATENT DOCUMENTS

| | | | |
|---|---|---|---|
| 3,449,213 | 6/1969 | Knapp et al. | 219/10.55 A |
| 3,560,347 | 2/1971 | Knapp et al. | 219/10.55 A |
| 3,622,733 | 11/1971 | Smith et al. | 219/10.55 A |
| 3,872,603 | 3/1975 | Williams et al. | 219/10.55 A |
| 3,992,287 | 11/1976 | Rhys | 219/10.55 A X |
| 4,045,639 | 8/1977 | Meisel | 219/10.55 A |

FOREIGN PATENT DOCUMENTS 1092861 11/1967 United Kingdom .

OTHER PUBLICATIONS

Aronov, S. G. *High-Frequency Heating of Coal,* The Engineers Digest, vol. 17, No. 4, Apr. 1956, pp. 133-135.

*Primary Examiner*—Arthur T. Grimley

*Attorney, Agent, or Firm*—Wenderoth, Lind & Ponack

[57] ABSTRACT

Coal, particularly ground coal, is thermally treated at a treatment zone by exposing the coal to microwave radiation, preferably at a frequency of from 20 to 3,000 MHz. The treatment zone may be a system for forming the coal into pellets or briquettes. The treatment zone may also be an area between a coal supply bin and a furnace or oven for utilization of the coal, whereby the coal is dried and/or preheated before use in the furnace or oven.

15 Claims, 3 Drawing Figures

PROCESS AND APPARATUS FOR THE THERMAL TREATMENT OF COAL

BACKGROUND OF THE INVENTION

The present invention relates to a process and an apparatus for the thermal treatment of coal, for example for the drying and/or preheating of ground coal, before the coal is introduced into a coking or gasification furnace or oven.

There are presently known various processes for drying and/or preheating ground coal before the charging thereof into a coking or gasification furnace or oven. However, such systems involve drying and/or preheating the coal in one or several flue flow tubes by means of hot gases. Thus, the systems for performing these known processes are very complex, and also these known processes require the availability of the necessary hot gases. An additional disadvantage of such known processes involves the fact that during the drying and/or preheating, there is generated very fine coal dust due to a reduction in the grain size of the coal during passage through the flue flow tubes, and the generation of such very fine coal dust presents a safety hazard due to the danger of explosion.

SUMMARY OF THE INVENTION

With the above discussion in mind, it is the primary object of the present invention to provide a novel process and apparatus for drying and/or preheating of coal, particularly ground coal to be charged into a coking or gasification furnace or oven, wherein it is possible to avoid the prior art disadvantages.

It is a further object of the present invention to provide such a process and an apparatus for drying and/or preheating coal by exposing the coal to microwave radiation.

It is a more general object of the present invention to provide a process and an apparatus for the thermal treatment of coal by exposing the coal to microwave radiation.

It is of course known to use microwave radiation for the defrosting, heating, cooking and baking of food in restaurants and homes, for the hardening of shaped elements of solid material to which aqueous bonding agents are added, for the sintering of melting of ceramic or fire-resistant products, and for the cementing of wooden edges. On the other hand, it is common knowledge that not all kinds of materials can be heated in a desired manner with microwave radiation, since the heat developed per unit of volume and per unit of time depends on the field intensity including the operational frequency on the one hand, and on the other hand, on the dielectric constant of the material involved.

It has however surprisingly been found that coal may be quickly dried and/or preheated by exposing the coal to microwave radiation, particularly microwave radiation at a frequency range of from 20 to 3,000 MHz.

Specifically, the coal, particularly ground coal, may be preheated and/or dried by passing the coal through a treatment zone while exposing the coal to microwave radiation.

The treatment zone may be in the form of a substantially enclosed chamber through which the coal is continuously passed by means of a conveyor, such as an endless conveyor belt. The coal may be exposed to microwave radiation by means of microwave electrodes, preferably in the form of plates, positioned on opposite sides of the coal continuously passing through the enclosed chamber.

Also, the treatment zone may be in the form of an inclined chute having therein one or more inclined microwave electrode plates.

Also, the treatment zone may be in the form of a vertical bin with one or more vertical electrode plates extending vertically through the bin.

In accordance with a further feature of the present invention, the treatment zone may be a known system for forming ground coal into pellets or briquettes, and the coal may be exposed to the microwave radiation during such pelletizing or briquetting. This is advantageous since the microwave radiation produces, within a very short period of time, the necessary heat in the formed pellets or briquettes for softening of the carbon particles thereof.

The treatment zone may be designed as a waveguide or as a cavity or chamber resonator.

Air, particularly dry air, may be passed through the treatment zone or through the coal passing through the treatment zone to remove moisture from the coal, thereby facilitating the drying of the coal. The air may also be hot to prevent the recondensation of the moisture. Air that is introduced into the treatment zone may be withdrawn therefrom in the form of humid air. In a specifically advantageous feature of the present invention, the energy used for heating the air may be derived from energy losses of the electrical system employed for the production of the microwave energy.

The treatment zone may be a part of a specially designed treatment system, part of a conventional coal bin, part of a conventional weighing bunker, part of a conventional supply chute between a conventional coal bin and a conventional charging truck, part of a conventional charging truck, or part of a conventional charging shaft of a furnace or an oven.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

Figure 1:
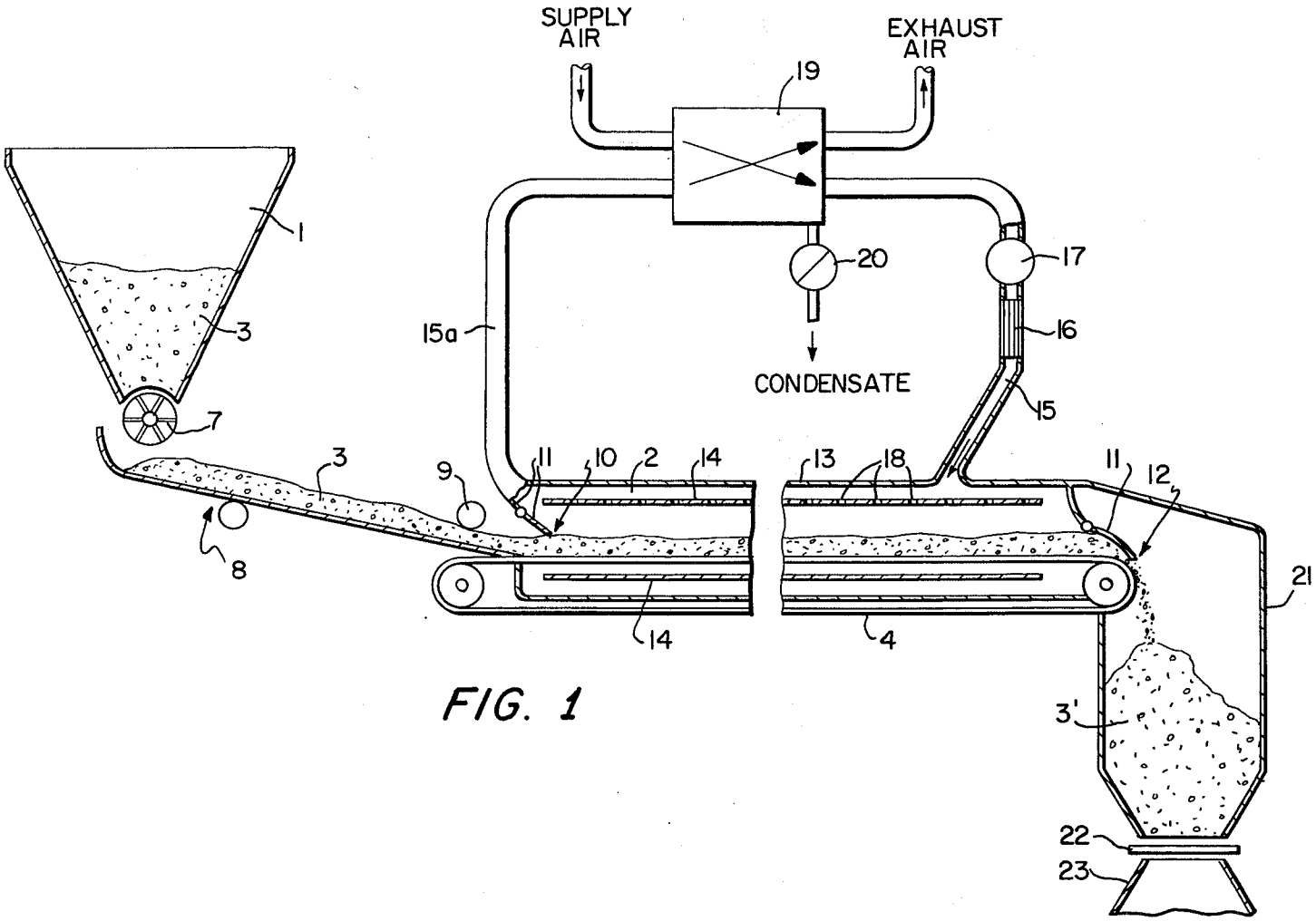
FIG. 1 is a schematic cross-sectional view of a first embodiment of the present invention.

With reference now to FIG. 1 of the drawings, a first embodiment of the present invention will be described.

Ground coal 3 is discharged from storage bin 1, tapered downwardly in a funnel-like manner, through a discharge device 7, for example designed as a cell wheel lock, and is deposited across the entire width of a conveying device 8 in a preferably uniformly thick layer of ground coal. Conveying device 8 may preferably be in the form of vibrating troughs. Device 8 is inclined, and at the lower end thereof a distributing device 9 provides for a uniform thickness of the layer of coal directly before the coal 3 enters into a special treatment zone 2.

The treatment zone 2 is preferably in the form of a substantially enclosed chamber. Just before entering the inlet opening 10 of the treatment zone 2, the coal is transferred onto an endless conveyor belt 4, the upper run of which extends through the treatment zone 2. The inlet opening 10 presents an opening which is just sufficient to permit entry of the layer of coal and the upper run of the belt 4. The inlet opening 10 is otherwise closed off to prevent the escape of microwave radiation, for example by means of flap 11 sliding on the coal layer, and by means of known band elimination filters (not shown), if necessary. The thickness of the coal layer may be, for example, approximately 100 mm.

Similarly, outlet opening 12 on the opposite end of treatment zone 2 has a flap 11 designed to limit the size of the outlet opening, and such outlet opening may also be provided with known band elimination filter (not shown), if necessary.

The treatment zone 2 is defined and surrounded by a casing 13 in which microwave electrodes, preferably in the form of electrode plates 14, are positioned on opposite sides of the coal layer. The coal layer and the upper run of belt 4 pass between the microwave electrode plates 14 at a desired speed to achieve the desired thermal treatment, for example at a speed in the range of between eight and twelve meters per minute. It will be apparent to those skilled in the art that the speed of the conveyor belt is dependent, inter alia, on the effective length of the treatment zone 2, on the humidity content of the coal to be treated, on the grain size of the coal to be treated, on the microwave intensity, and on the size of the gaps between the electrode 14 and the layer of coal.

The microwave field for the desired thermal treatment, for example drying and/or preheating of the coal, may be produced in an otherwise known manner, for example by means of a source (not shown) connected to the electrodes 14, and operating at a suitable voltage and frequency. For example, the voltage may be approximately 9,000 volts and the frequency may be approximately 2,450 MHz.

A ventilating duct 15 is connected to the interior of casing 13, and dry air, preheated by heating unit 16, is introduced into treatment zone 2 through duct 15 by means of a fan 17. Inlet openings 18 may be provided in the upper electrode plate 14 for the purpose of distributing the air flow over the layer of coal passing through the treatment zone. Thus, the dry air absorbs humidity or moisture from the surface of the coal layer at an end of the treatment zone 2, the humidity or moisture containing air is removed via duct 15*a* and is discharged as exhaust air after being passed through a humidity condenser 19. The resultant condensate may be collected as at 20. The heating unit 16 can be operated utilizing heat resulting from energy loss of the electrical system for the production of the microwave radiation (not shown).

From the outlet opening 12, the dried and possibly preheated coal 3' is discharged into a hot coal bin 21 from where it is supplied in a customary manner, for example through a gate valve 22 and a weighing bin 23, to a coking or gasification furnace or oven (not shown).

Figure 2:
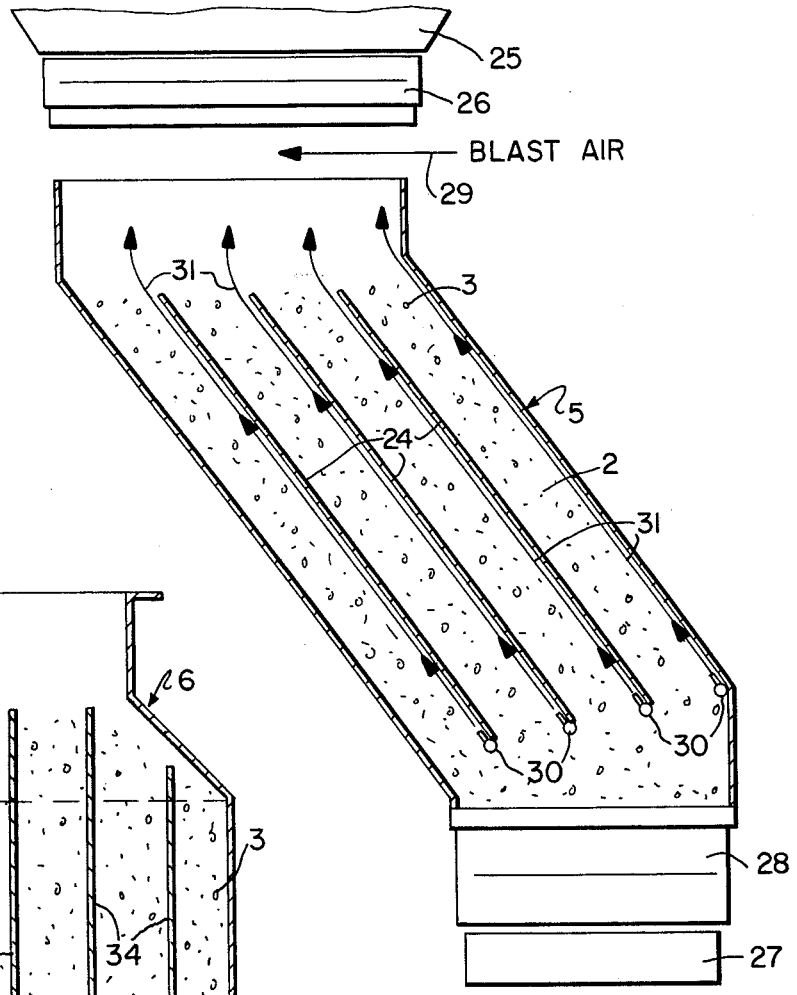
FIG. 2 is a schematic cross-sectional view of a second embodiment of the present invention.

With reference now to FIG. 2 of the drawings a second embodiment of the invention will be described.

In this embodiment of the present invention, the treatment zone is in the form of an inclined supply shaft or chute 5 having therein a plurality of microwave electrode plates 24 which are also inclined to be substantially parallel to the inclined surfaces of the chute 5 and to thereby divide the interior of the chute into a plurality of inclined channels. The coal is supplied into the open upper end of the chute 5 and passes downwardly in inclined paths through the chute while being exposed to microwave radiation from the electrode plates 24.

The supply chute 5 can be arranged at any convenient position between a conventional coal bin containing a supply of humid or moist coal and a conventional coking or gasification furnace or oven, i.e. at any position along the coal path between such bin and furnace or oven.

In the position illustrated in FIG. 2, the supply chute 5 is located between a coal bin 25 which is provided at the lower end thereof with a discharge device 26 and, for example, a charging truck 27. The lower, outlet end of chute 5 is provided with a discharge device 28 to remove the dried and possibly preheated coal at a desired speed. Such discharge speed will of course determine the speed of passage of the coal through the microwave field within the chute 5.

A flow of blast air 29 can be made to pass over the open upper end of the supply chute 5 to remove humidity from the coal therein. However, if necessary, such air flow can also be provided along the inner walls of the chute 5 by providing, for example, a screen insert with the required narrow mesh size in the chute 5.

Also, air nozzles, for example in the form of perforated tubes 30, may be located at the lower edges of the electrode plate 24 and at the lower end of the uppermost inclined wall of the chute 5. Dry air may be discharged from perforated nozzle tubes 30 to thereby cause air to flow in upwardly inclined paths through the coal and along the lower inclined surfaces of the electrode plates 24 and the lower inclined surface of the uppermost inclined wall of the chute 5, as indicated by arrows 31. Such air flows will act to remove moisture from the coal. The air flowing through perforated nozzle tubes 30 may also be hot air to prevent recondensation of the moisture.

Figure 3:
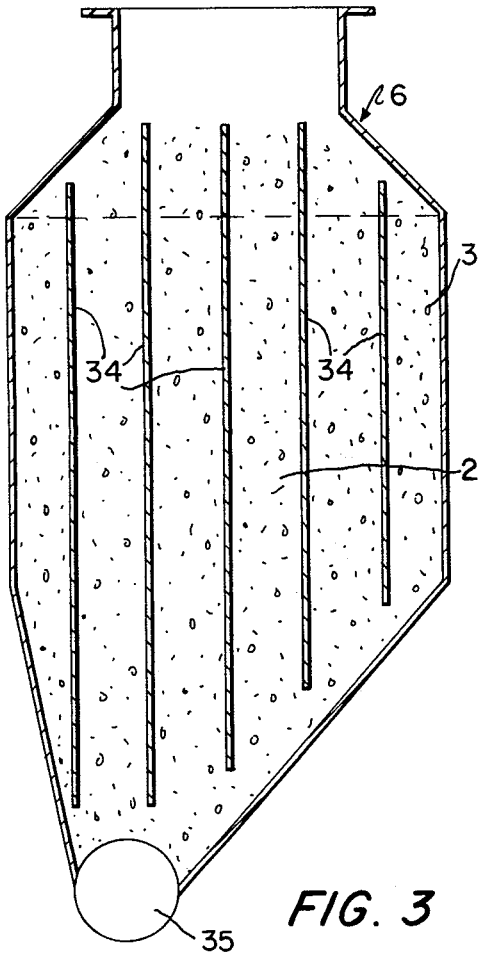
FIG. 3 is a schematic cross-sectional view of a third embodiment of the present invention.

With reference now to FIG. 3 of the drawings, a third embodiment of the present invention will be described.

In this embodiment of the invention, the treatment zone is in the form of a conventional coal bin 6 which extends substantially vertically and which has an open upper end for the introduction of moist coal and a lower end closed by a discharge device 35 for discharging dried and/or preheated coal from the bottom of the bin.

The moist coal is dried and/or preheated by exposing the coal to microwave radiation by means of vertically extending electrode plates 34, connected to a source of microwave energy in a known manner (not shown).

It is to be understood that the bin 6 of the embodiment of FIG. 3 could be provided with moisture removing air in manner similar to those described above with regard to the previous embodiments.

Additionally, the coal bin 6 shown in FIG. 3 can be a container top of a conventional charging truck which can be put in a relatively fixed position to receive the necessary energy for the treatment of the coal so that the predominant portion of the electrical system for the production of the microwave field will remain stationary.

Although the present invention has been described above and has been illustrated with regard to certain specific structural and operational features, it is to be understood that various modifications may be made thereto without departing from the scope of the present invention. Specifically, the configurations of the actual treatment zones may be other than as illustrated. Also, the configurations of the various microwave electrodes may be other than as specifically illustrated. It is of course to be understood that the electrodes will in all cases be designed in accordance with known concepts to provide an operationally safe structure whereby leakage of microwave energy is prevented. It is further to be understood that the microwave energy source may be any conventional and known source and may be operatively connected to the electrodes in any conventional and known manner. Further, the treatment zone may be designed in accordance with known concepts as a waveguide or as a cavity or chamber resonator.

What we claim is:

1. An apparatus for the thermal treatment of coal, said apparatus comprising:

a treatment zone through which coal is passed, said treatment zone comprising a substantially enclosed chamber, and conveyor means for continuously passing ground coal through said enclosed chamber, said conveyor means comprising an endless conveyor belt having an upper run extending through said chamber; and means associated with said treatment zone for thereat exposing said coal to microwave radiation, said exposing means comprising microwave electrodes in the form of plates positioned above and below said upper run of said endless belt conveyor.

2. An apparatus for the thermal treatment of coal, said apparatus comprising:

a treatment zone through which coal is passed, said treatment zone comprising a downwardly inclined chute having an open upper end for the supply thereto of said coal and at the lower end thereof a coal discharge device; and means associated with said treatment zone for thereat exposing said coal to microwave radiation, said exposing means comprising at least one microwave electrode positioned within said chute.

3. An apparatus for the thermal treatment apparatus comprising:

a treatment zone through which coal is passed, said treatment zone comprising a vertically extending bin having an open upper end for the supply thereto of said coal and at the lower end thereof a coal discharge device; and means associated with said treatment zone for thereat exposing said coal to microwave radiation, said exposing means comprising at least one microwave electrode positioned within said bin.

4. An apparatus as claimed in claims 1, 2 or 3, wherein said exposing means comprises means for generating microwave radiation at a frequency of from 20 to 3,000 MHz.

5. An apparatus as claimed in claims 1, 2 or 3, wherein said treatment zone comprises a waveguide.

6. An apparatus as claimed in claims 1, 2 or 3, wherein said treatment zone comprises a cavity or chamber resonator.

7. An apparatus as claimed in claim 1, further comprising means for passing dry air through said chamber and for thereby removing moisture from said coal.

8. An apparatus as claimed in claim 1, wherein said chamber is positioned between a coal supply bin and a furnace for utilization of said coal.

9. An apparatus as claimed in claim 2, wherein said electrode comprises an inclined plate extending substantially throughout the height of said chute and thereby dividing the interior of said chute into plural inclined channels.

10. An apparatus as claimed in claim 9, comprising a plurality of said inclined plates.

11. An apparatus as claimed in claim 10, further comprising means for passing dry and hot air upwardly through said coal in said chute and for thereby removing moisture from said coal and preventing recondensation of said moisture.

12. An apparatus as claimed in claim 11, wherein said air passing means comprise air nozzles arranged at the lower edges of said plates and at least one of the walls of said chute, such that air issuing from said nozzles passes in inclined upward directions along the lower inclined surfaces of said plates and said chute wall.

13. An apparatus as claimed in claim 2, further comprising means for passing dry air over said open upper end of said chute and for thereby removing moisture from said coal.

14. An apparatus as claimed in claim 3, wherein said electrode comprises a vertical plate extending substantially throughout the height of said bin and thereby dividing the interior of said bin into plural vertical channels.

15. An apparatus as claimed in claim 14, comprising a plurality of said vertical plates.

* * * * *